US010205268B1

(12) United States Patent
Mellott et al.

(10) Patent No.: US 10,205,268 B1
(45) Date of Patent: Feb. 12, 2019

(54) ELECTRICAL CONNECTOR HAVING CABLE SEALS PROVIDING ELECTROMAGNETIC SHIELDING

(71) Applicant: Aptiv Technologies Limited, St. Michael (BB)

(72) Inventors: Michael L. Mellott, Youngstown, OH (US); Glenn E. Robison, Youngstown, OH (US); Mark A. Scheel, Canfield, OH (US)

(73) Assignee: APTIV TECHNOLOGIES LIMITED (BB)

( * ) Notice: Subject to any disclaimer, the term of this patent is extended or adjusted under 35 U.S.C. 154(b) by 0 days.

(21) Appl. No.: 15/850,864

(22) Filed: Dec. 21, 2017

(51) Int. Cl.
*H01R 13/52* (2006.01)
*H01R 43/00* (2006.01)
*H01R 13/6592* (2011.01)

(52) U.S. Cl.
CPC ..... *H01R 13/5205* (2013.01); *H01R 13/6592* (2013.01); *H01R 43/005* (2013.01)

(58) Field of Classification Search
CPC ..... H01R 13/5205; H01R 13/6592; H01R 13/5202; H01R 13/521; H01R 43/005
USPC .... 439/604, 607.01, 607.02, 607.04, 607.17, 439/607.27, 607.41, 583, 578
See application file for complete search history.

(56) References Cited

U.S. PATENT DOCUMENTS 4,046,451 A * 9/1977 Juds ..... H01R 24/564 174/75 C
4,144,404 A * 3/1979 De Groef ..... B29C 61/0616 174/88 C
4,692,562 A 9/1987 Nattel
4,811,161 A * 3/1989 Sasaki ..... H01G 4/224 361/302
4,879,807 A * 11/1989 Roucaute ..... H01R 4/72 29/828
5,315,684 A * 5/1994 Szegda ..... G02B 6/3887 385/139
5,509,823 A 4/1996 Harting et al.
6,139,351 A 10/2000 Schaefer et al.
6,478,618 B2 * 11/2002 Wong ..... H01R 9/0524 439/585
7,144,272 B1 * 12/2006 Burris ..... H01R 9/05 439/578
7,497,729 B1 * 3/2009 Wei ..... H01R 9/0524 439/578

(Continued)

*Primary Examiner* — Tulsidas C Patel
*Assistant Examiner* — Peter G Leigh
(74) *Attorney, Agent, or Firm* — Robert J. Myers

(57) ABSTRACT

An electrical connector assembly includes a shielded wire cable having an inner core, an inner insulator surrounding the inner core, a cable shield surrounding the inner insulator, and an outer insulator surrounding the cable shield, a terminal attached to the inner core, a terminal shield surrounding the terminal, and a cable seal formed of an electrically conductive resilient material, wherein a first portion of the cable seal is in compressive contact with portions of the cable shield and the terminal shield, thereby providing an electrically conductive path between the cable shield and the terminal shield. The electrical connector assembly further includes a housing in which the terminal is disposed. A second portion of the cable seal is in compressive contact with a portion of the outer insulator and an inner wall of the housing, thereby inhibiting intrusion of contaminants into the housing.

16 Claims, 3 Drawing Sheets

(56) References Cited

U.S. PATENT DOCUMENTS

| | | | | |
|---|---|---|---|---|
| 7,553,185 | B1 * | 6/2009 | Qu | H01R 13/5219 439/578 |
| 7,934,954 | B1 * | 5/2011 | Chawgo | H01R 9/0524 439/578 |
| 8,047,870 | B2 * | 11/2011 | Clausen | H01R 9/0524 439/578 |
| 8,435,073 | B2 * | 5/2013 | Wild | H01R 24/564 439/578 |
| 8,708,737 | B2 * | 4/2014 | Chawgo | H01R 9/0524 439/578 |
| 9,172,156 | B2 * | 10/2015 | Nugent | H01R 9/0518 |
| 9,190,762 | B2 * | 11/2015 | Xu | H01R 13/502 |
| 9,281,637 | B2 * | 3/2016 | Holliday | H01R 9/0518 |
| 9,711,917 | B2 * | 7/2017 | Montena | H01R 24/38 |
| 9,748,704 | B2 * | 8/2017 | Wang | H01R 13/5205 |
| 2011/0263154 | A1 * | 10/2011 | Chawgo | H01R 9/0524 439/584 |
| 2012/0056416 | A1 | 3/2012 | Briand | |
| 2012/0088404 | A1 * | 4/2012 | Wild | H01R 24/564 439/584 |
| 2012/0088407 | A1 * | 4/2012 | Natoli | H01R 24/564 439/585 |
| 2014/0045357 | A1 * | 2/2014 | Nugent | H01R 13/5221 439/275 |

* cited by examiner

ELECTRICAL CONNECTOR HAVING CABLE SEALS PROVIDING ELECTROMAGNETIC SHIELDING

TECHNICAL FIELD OF THE INVENTION

The invention generally relates to electrical connectors and more particularly relates to electrical connectors having cable seals providing electromagnetic shielding.

BACKGROUND OF THE INVENTION

Cable seals have been used to prevent environmental contaminants (typically liquids) from entering into the connector housings of electrical connector assemblies and thereby into the terminal electrical contact areas of electrical connector assemblies. Existing connector assemblies use cable seals, typically made of silicone rubber, with a 2 or 3-rib peripheral design that has been thoroughly tested and proven to seal the cable to the housing.

The addition of carbon and/or other electrically conductive materials will cause silicone rubber to be mildly electrically conductive as discussed in U.S. Pat. No. 5,509,823. Gaskets made of this "conductive silicone" have been used in concepts for sealing a connector housing to a mounting panel as discussed in U.S. Pat. No. 6,139,351.

High voltage connection system typically require electromagnetic interference (EMI) shielding within the frequency range of 0.5 to 110 megahertz (MHz). A shielded wire cable with a wire braid cable shield is typically used in these applications. According to the electrical connector assembly 100 illustrated in FIG. 1, the shielded cable 102 is installed in the housing 120 and the cable shield 108 is connected to an terminal shield 122 that surrounds the terminal 112 terminating the inner core 104 of the shielded cable 102. In the illustrated example, the terminal shield 122 is formed by a sheet metal can or shell.

The cable shield 108 and terminal shield 122 is connected by a pair of crimped ferrules, where the cable shield 108 is captured between an inner ferrule 132 and an outer ferrule 134. This connection between the cable shield 108 and terminal shield 122 requires the addition of the ferrules 132, 134 to create the interface. Additionally, a relatively large amount of space within the housing 120 is needed to accommodate crimp tooling to attach the ferrules 132, 134 to the shielded cable 102 as well as the cable seal 124. This space requires a larger connector assembly 100 which is a design concern in the restricted packaging spaces allowed for wiring and the associated connectors in modern vehicles. Therefore, a smaller sealed electrical connector assembly for shielded wire cables remains desired.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

A sealed electrical connector assembly for a shielded wire cable is described herein. The cable seals are formed of a resilient, electrically conductive material so that the cable seal both provide sealing between the shielded cable and a housing of the electrical connector as well as providing an electrical connection between a cable shield and a terminal shield within the electrical connector.

Figure 2:
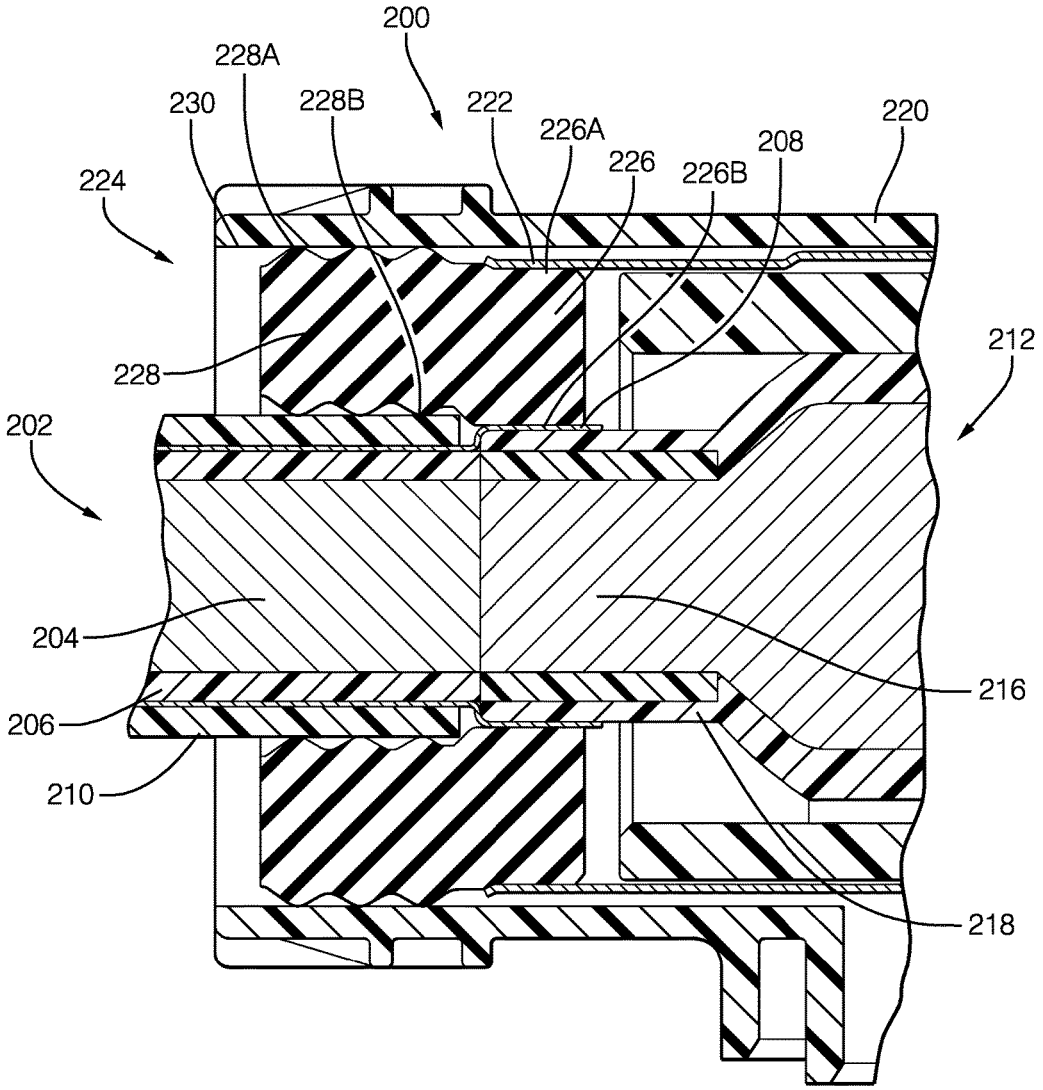
FIG. 2 is a cross section side view of an electrical connector assembly according to one embodiment of the invention.

FIG. 2 illustrates a non-limiting example of an electrical connector assembly, hereinafter referred to as the assembly 200. The assembly 200 includes a shielded wire cable 202 having an elongate conductive inner core 204 formed of a metallic material such as a copper based or aluminum based alloy. The inner core 204 may be a solid wire or may be a bundle of multiple wire strands. The inner core 204 may alternatively be formed on a non-metallic electrical conductor, such as a conductive polymer material, carbon nanotube based material or a conductive polymer/metallic hybrid material. The inner core 204 is longitudinally surrounded by an inner insulator jacket, hereinafter referred to as the inner jacket 206, formed of a dielectric material, such as polyethylene, polypropylene, or polyvinyl chloride. A cable shield 208 formed of braided copper wire strands longitudinally surrounds the inner insulator. Alternative embodiments may have a cable shield 208 formed of braided aluminum wires, a conductive foil, or a non-metallic electrical conductor surrounding the inner jacket 206. The cable shield 208 longitudinally surrounds an outer insulator jacket, hereinafter referred to as the outer jacket 210. The outer jacket 210 is also formed of a dielectric material, such as polyethylene, polypropylene, or polyvinyl chloride. A portion of the outer jacket 210, the cable shield 208, and the inner jacket 206 on an end of the shielded wire cable 202 is removed to expose the inner core 204. Another portion of the outer jacket 210 adjacent the exposed inner core 204 is also removed to expose the cable shield 208.

A terminal 212 formed on an electrically conductive material is attached to the inner core 204. The terminal 212 includes a connection portion 214, e.g. a male blade or female socket, that configured to interface with a corresponding mating terminal (not shown). The terminal 212 also includes an attachment portion 216, e.g. an open or closed crimping barrel.

A terminal insulator 218 longitudinally surrounds at least a portion of the attachment portion 216 of the terminal 212. In the illustrated example, the terminal insulator 218 is formed by a tube of thermoplastic heat shrinkable material, such as polyolefin, polyvinyl chloride, polytetrafluoroethylene, or fluorinated ethylene propylene. The terminal insulator 218 is disposed intermediate the attachment portion 216 of the terminal 212 and the exposed portion of the cable shield 208. The terminal insulator 218 provides a means for electrically insulating the cable shield 208 from the attachment portion 216.

The assembly 200 further comprises a housing 220 formed of a dielectric material, such as polyamide or polybutylene terephthalate, defining an inner cavity in which the terminal 212 is disposed. A terminal shield 222 formed of an electrical conductive material, such as sheet metal, is also disposed within the housing 220 and longitudinally surrounds the terminal 212.

The assembly 200 also includes a cable seal 224 formed of an electrically conductive resilient material, such as a graphite filled silicone elastomer. The exposed portion of the cable shield 208 is disposed intermediate the terminal insulator 218 and the cable seal 224. A first portion 226 of the cable seal 224 is in compressive contact with the exposed portion of the cable shield 208 and the terminal shield 222, thereby providing an electrically conductive path between the cable shield 208 and the terminal shield 222. A second portion 228 of the cable seal 224 is in compressive contact with a portion of the outer insulator and an inner wall 230 of the housing 220, thereby inhibiting intrusion of environmental contaminants, such as water, other fluids, or dust into the housing 220.

A first outer surface 226A of the first portion 226 of the cable seal 224 that is in compressive contact with the terminal shield 222 has a generally flat profile. A second outer surface 228A of the second portion 228 of the cable that is in compressive contact with the inner wall 230 has an undulating profile formed by multiple ribs extending radially about the cable seal 224.

A first inner surface 226B of the first portion 226 of the cable seal 224 that is in compressive contact with the cable shield 208 also has a generally flat profile. A second inner surface 228B of the second portion 228 the cable seal 224 that is in compressive contact with the outer insulator similarly has an undulating profile formed by multiple ribs extending radially about the cable seal 224.

The cable seal 224 provides a unitary means for providing an electrically conductive path between the cable shield 208 and the terminal shield 222 while also providing a seal between the outer insulator and the housing 220 configured to inhibit intrusion of contaminants into the housing 220.

Figure 3:
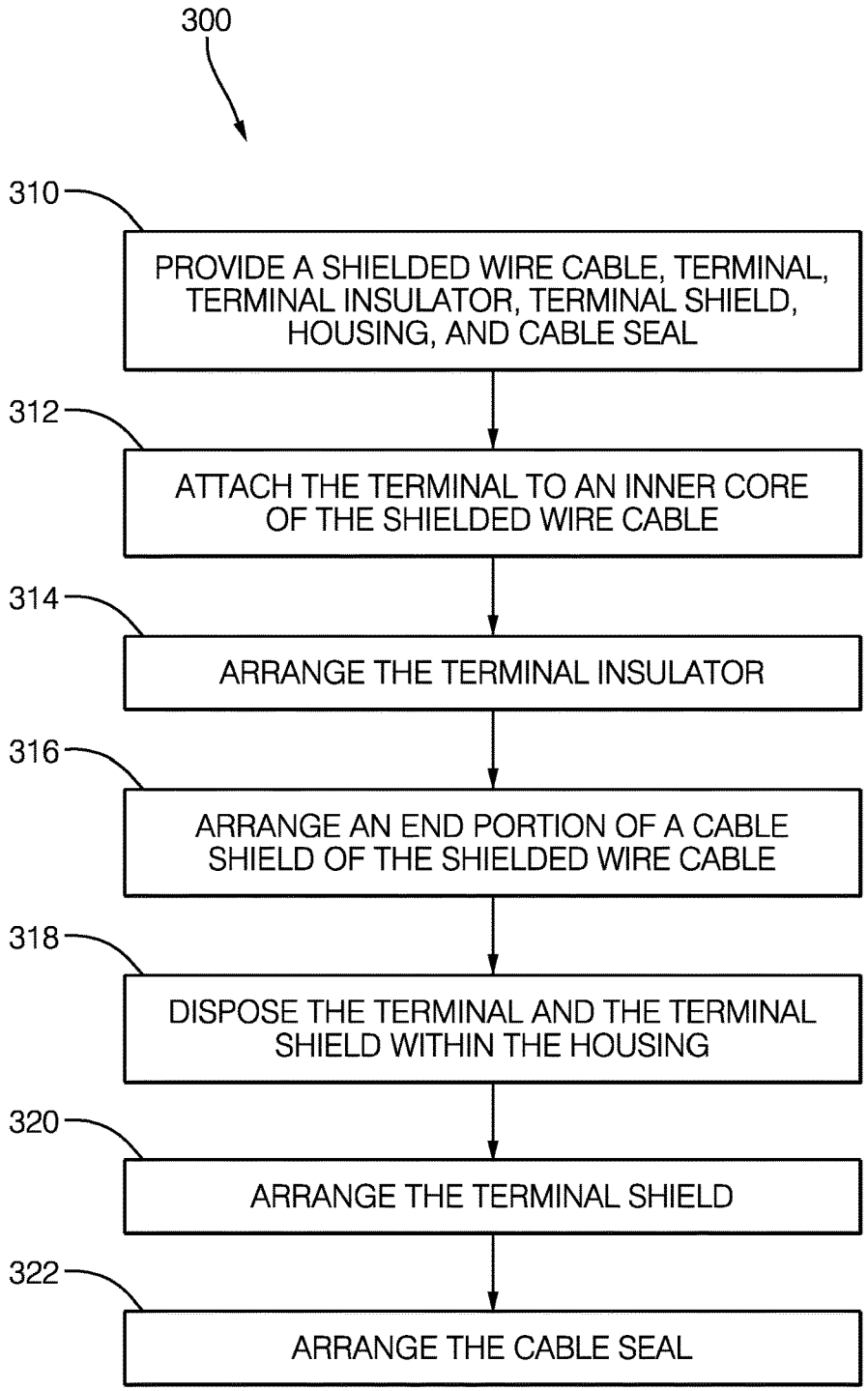
FIG. 3 is a flowchart for a method of manufacturing an electrical connector assembly according to one embodiment of the invention.

FIG. 3 illustrates a non-limiting example of a method of forming the electrical connector assembly described above. The steps of the method are described below:

STEP 310, PROVIDE A SHIELDED WIRE CABLE, TERMINAL, TERMINAL INSULATOR, TERMINAL SHIELD, HOUSING, AND CABLE SEAL, includes providing a shielded wire cable 202 having an inner core 204, an inner jacket 206 surrounding the inner core 204, a cable shield 208 surrounding the inner insulator, and an outer jacket 210 surrounding the cable shield 208, providing a terminal 212 having a connection portion 214 configured to interface with a corresponding mating terminal 212 and an attachment portion 216 configured to attach to the inner core 204, providing a terminal insulator 218, providing a terminal shield 222, providing a housing 220 in which the terminal 212 is disposed, and providing a cable seal 224 formed of an electrically conductive resilient material.

STEP 312, ATTACH THE TERMINAL TO AN INNER CORE OF THE SHIELDED WIRE CABLE, includes attaching the terminal 212 to an exposed portion of the inner core 204 of the shielded wire cable 202.

STEP 314, ARRANGE THE TERMINAL INSULATOR, includes arranging the terminal insulator 218 so that the terminal insulator 218 surrounds at least a portion of the attachment portion 216.

STEP 316, ARRANGE AN END PORTION OF THE CABLE SHIELD, includes arranging an end portion of the cable shield 208 so that the end portion of the cable shield 208 surrounds at least a portion of the terminal insulator 218.

STEP 318, DISPOSE THE TERMINAL AND THE TERMINAL SHIELD WITHIN THE HOUSING, includes disposing the terminal 212 and the terminal shield 222 within the housing 220.

STEP 320, ARRANGE THE TERMINAL SHIELD, includes arranging the terminal shield 222 so that the terminal shield 222 surrounds the terminal 212.

STEP 322, ARRANGE THE CABLE SEAL, includes arranging the cable seal 224 so that a first portion 226 of the cable seal 224 is in compressive contact with portions of the cable shield 208 and the terminal shield 222, thereby providing an electrically conductive path between the cable shield 208 and the terminal shield 222 and arranging the cable seal 224 so that a second portion 228 of the cable seal 224 is in compressive contact with a portion of the outer insulator and an inner wall 230 of the housing 220, thereby inhibiting intrusion of contaminants into the housing 220.

Figure 1:
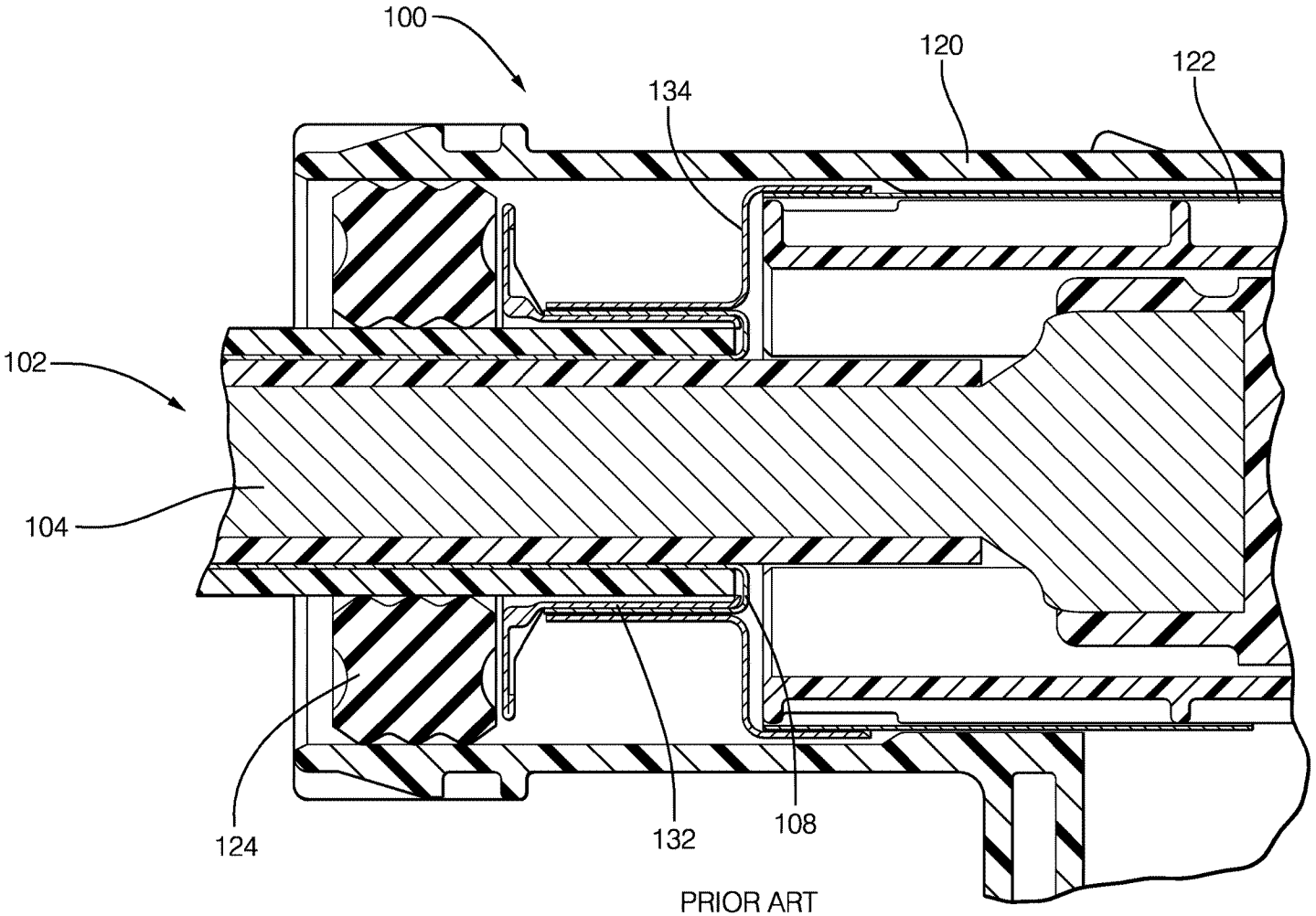
PRIOR ART FIG. 1
FIG. 1 is a cross section side view of an electrical connector assembly according to the prior art.

Accordingly, an electrical connector assembly 200 and a method 300 of manufacturing such an electrical connector assembly 200 is provided. This electrical connector assembly 200 provides the advantages of eliminating the need for a separate inner and outer ferrule to connect the cable shield 208 to the terminal shield 222, thereby eliminating the cost of the ferrules and the cost and time of attaching the ferrules to the cable shield 208 and terminal shield 222 in the manufacturing process. The elimination of the ferrules also reduces the size of the assembly 200 since the housing 220 no longer needs to accommodate the ferrules as can be seen in a comparison of FIGS. 1 and 2.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. An electrical connector assembly, comprising:

a shielded wire cable having an inner core, an inner insulator surrounding the inner core, a cable shield surrounding the inner insulator, and an outer insulator surrounding the cable shield;

a terminal attached to the inner core;

a terminal shield surrounding the terminal;

a cable seal formed of an electrically conductive resilient material, wherein a first portion of the cable seal is in compressive contact with portions of the cable shield and the terminal shield, thereby providing an electrically conductive path between the cable shield and the terminal shield; and a housing in which the terminal is disposed, wherein a second portion of the cable seal is in compressive contact with a portion of the outer insulator and an inner wall of the housing, thereby inhibiting intrusion of contaminants into the housing and wherein a first outer surface of the first portion in compressive contact with the terminal shield has a generally flat profile and a second outer surface of the second portion in compressive contact with the inner wall has an undulating profile.

2. The electrical connector assembly according to claim 1, wherein the terminal includes a connection portion configured to interface with a corresponding mating terminal and an attachment portion attached to the inner core, wherein the electrical connector assembly further comprises a terminal insulator surrounding at least a portion of the attachment portion, and wherein an end portion of the cable shield is disposed intermediate the terminal insulator and the cable seal.

3. The electrical connector assembly according to claim 2, wherein the terminal insulator is formed of a thermoplastic heat shrinkable material.

4. The electrical connector assembly according to claim 1, wherein the cable seal is formed of a conductive silicone based material.

5. The electrical connector assembly according to claim 1, wherein a first inner surface of the first portion in compressive contact with the cable shield has a generally flat profile and a second inner surface of the second portion in compressive contact with the outer insulator has an undulating profile.

6. An electrical connector assembly, comprising:

a shielded wire cable having an inner core, an inner insulator surrounding the inner core, a cable shield surrounding the inner insulator, and an outer insulator surrounding the cable shield;

a terminal attached to the inner core;

a terminal shield surrounding the terminal;

a cable seal formed of an electrically conductive resilient material, wherein a first portion of the cable seal is in compressive contact with portions of the cable shield and the terminal shield, thereby providing an electrically conductive path between the cable shield and the terminal shield; and a housing in which the terminal is disposed, wherein a second portion of the cable seal is in compressive contact with a portion of the outer insulator and an inner wall of the housing, thereby inhibiting intrusion of contaminants into the housing and wherein a first inner surface of the first portion in compressive contact with the cable shield has a generally flat profile and a second inner surface of the second portion in compressive contact with the outer insulator has an undulating profile.

7. The electrical connector assembly according to claim 6, wherein the terminal includes a connection portion configured to interface with a corresponding mating terminal and an attachment portion attached to the inner core, wherein the electrical connector assembly further comprises a terminal insulator surrounding at least a portion of the attachment portion, and wherein an end portion of the cable shield is disposed intermediate the terminal insulator and the cable seal.

8. The electrical connector assembly according to claim 7, wherein the terminal insulator is formed of a thermoplastic heat shrinkable material.

9. The electrical connector assembly according to claim 6, wherein the cable seal is formed of a conductive silicone based material.

10. A method of manufacturing an electrical connector assembly, comprising the steps of:

providing a shielded wire cable having an inner core, an inner insulator surrounding the inner core, a cable shield surrounding the inner insulator, and an outer insulator surrounding the cable shield;

providing a terminal having a connection portion configured to interface with a corresponding mating terminal and an attachment portion configured to attach to the inner core;

providing a terminal insulator;

providing a terminal shield;

providing a cable seal formed of an electrically conductive resilient material;

attaching the terminal to the inner core;

arranging the terminal insulator so that the terminal insulator surrounds at least a portion of the attachment portion;

arranging an end portion of the cable shield so that the end portion of the cable shield surrounds at least a portion of the terminal insulator;

arranging the terminal shield so that the terminal shield surrounds the terminal;

arranging the cable seal so that a first portion of the cable seal is in compressive contact with portions of the cable shield and the terminal shield, thereby providing an electrically conductive path between the cable shield and the terminal shield;

providing a housing in which the terminal is disposed;

disposing the terminal and the terminal shield within the housing; and arranging the cable seal so that a second portion of the cable seal is in compressive contact with a portion of the outer insulator and an inner wall of the housing, thereby inhibiting intrusion of contaminants into the housing, wherein a first outer surface of the first portion in compressive contact with the terminal shield has a generally flat profile and a second outer surface of the second portion in compressive contact with the inner wall has an undulating profile.

11. The method according to any one of claim 10, wherein the cable seal is formed of a conductive silicone based material.

12. The method according to any one of the claim 10, wherein the terminal insulator is formed of a thermoplastic heat shrinkable material.

13. The method according to any one of claim 10, wherein a first inner surface of the first portion in compressive contact with the cable shield has a generally flat profile and a second inner surface of the second portion in compressive contact with the outer insulator has an undulating profile.

14. A method of manufacturing an electrical connector assembly, comprising the steps of:

providing a shielded wire cable having an inner core, an inner insulator surrounding the inner core, a cable shield surrounding the inner insulator, and an outer insulator surrounding the cable shield;

providing a terminal having a connection portion configured to interface with a corresponding mating terminal and an attachment portion configured to attach to the inner core;

providing a terminal insulator;

providing a terminal shield;

providing a cable seal formed of an electrically conductive resilient material;

attaching the terminal to the inner core;

arranging the terminal insulator so that the terminal insulator surrounds at least a portion of the attachment portion;

arranging an end portion of the cable shield so that the end portion of the cable shield surrounds at least a portion of the terminal insulator;

arranging the terminal shield so that the terminal shield surrounds the terminal;

arranging the cable seal so that a first portion of the cable seal is in compressive contact with portions of the cable shield and the terminal shield, thereby providing an electrically conductive path between the cable shield and the terminal shield;

providing a housing in which the terminal is disposed;

disposing the terminal and the terminal shield within the housing; and arranging the cable seal so that a second portion of the cable seal is in compressive contact with a portion of the outer insulator and an inner wall of the housing, thereby inhibiting intrusion of contaminants into the housing, wherein a first inner surface of the first portion in compressive contact with the cable shield has a generally flat profile and a second inner surface of the second portion in compressive contact with the outer insulator has an undulating profile.

15. The method according to any one of claim 14, wherein the cable seal is formed of a conductive silicone based material.

16. The method according to any one of the claim 14, wherein the terminal insulator is formed of a thermoplastic heat shrinkable material.

* * * * *